US006588742B2

(12) United States Patent
Matsukawa

(10) Patent No.: US 6,588,742 B2
(45) Date of Patent: Jul. 8, 2003

(54) SHEET FEEDER AND SHEET TRAY

(75) Inventor: Chiharu Matsukawa, Osaka (JP)

(73) Assignee: Funai Electric Co., Ltd., Daito (JP)

( * ) Notice: Subject to any disclaimer, the term of this patent is extended or adjusted under 35 U.S.C. 154(b) by 43 days.

(21) Appl. No.: 10/008,490

(22) Filed: Nov. 13, 2001

(65) Prior Publication Data

US 2002/0060401 A1 May 23, 2002

(30) Foreign Application Priority Data

Nov. 21, 2000 (JP) ..... 2000-008292

(51) Int. Cl.[7] ..... B65H 1/00
(52) U.S. Cl. ..... 271/145; 271/213
(58) Field of Search ..... 221/145, 218

(56) References Cited

U.S. PATENT DOCUMENTS 5,655,644 A * 8/1997 Graef ..... 198/437
5,897,113 A * 4/1999 Kondo et al. ..... 271/213
2001/0009625 A1 * 7/2001 Tamchira et al.

FOREIGN PATENT DOCUMENTS

| | | |
|---|---|---|
| JP | 6-329306 | 11/1994 |
| JP | 8-198480 | 8/1996 |
| JP | 9-300762 | 11/1997 |
| JP | 11-147320 | 6/1999 |

OTHER PUBLICATIONS

Japanese Patent Abstract; Publication No. 08–198480; Published on Aug. 6, 1996.
Japanese Patent Abstract; Publication No. 09–300762; Published on Nov. 25, 1997.
Japanese Patent Abstract; Publication No. 11–147320; Published on Jun. 2, 1999.
Japanese Patent Abstract; Publication No. 06–329306; Published on Nov. 29, 1994.

* cited by examiner

*Primary Examiner*—Donald P. Walsh
*Assistant Examiner*—Kenneth W Bower
(74) *Attorney, Agent, or Firm*—Rosenthal & Osha L.L.P.

(57) ABSTRACT

A sheet feeder has a sheet tray 10 that rotates around a shaft 12 perpendicularly to a sheet mounting surface, and is accommodated in a sheet feeder body. The sheet feeder has a sheet tray 11 disposed to rotate around the shaft 12 and connected to the tray 10 so that the tray 11 partly overlaps with the tray 10, and is accommodated in the sheet feeder body, and an abutting rib 13 for forwardly pushing the tray 11 when the sheet trays 10 and 11 are connected together. A part of the sheet tray 10 overlapping with the sheet tray 11, has a thin portion 10*a*. A part of the tray 11, overlapping with the sheet tray 10, has a thin portion 11*a*. The thin portions 10*a* and 11*a* butt against each other in an overlapping portion where the sheet trays 10 and 11 overlap with each other.

6 Claims, 6 Drawing Sheets

SHEET FEEDER AND SHEET TRAY

BACKGROUND OF THE INVENTION

1. Field of the Invention

The present invention generally relates to a sheet feeder and to a sheet tray. More particularly, the present invention relates to a sheet feeder having a sheet tray body enabled to be accommodated in a sheet feeder body, and to a sheet tray having such a tray body.

2. Description of the Related Art

Hitherto, sheet feeders each having a sheet tray enabled to be accommodated in a sheet feeder body have been known as sheet feeders for use in printers, plotters, and electronic copying machines. Such sheet feeders each having a sheet tray enabled to be accommodated in a sheet feeder body are disclosed in, for example, JP-A-8-81092, JP-B-6-71950, and JP-A-11-199101. Hereinafter, an ink jet printer is described as an example of conventional equipment having such a sheet feeder.

FIG. 10 is a perspective view illustrating a condition (that is, a used condition) in which the sheet trays are drawn out of a conventional ink jet printer having the drawer type sheet trays. FIG. 11 is a sectional side of the conventional ink jet printer having the drawer type sheet trays. FIG. 12 is a sectional side view illustrating an accommodated condition (that is, an unused condition) in which the sheet trays are accommodated in the conventional ink jet printer.

First, an outline of the configuration of the ink jet printer having the conventional drawer type trays 105 and 106 by referring to FIGS. 10 to 12. The conventional inkjet printer has a bottom cover 101, a back cover 102 disposed on the rear surface thereof, and a front cover 103 disposed on the front surface thereof. A sheet mounting portion 104 is provided on the bottom cover 101. The bottom cover 101, the back cover 102, and the front cover 103 cover a motor (not shown) for driving a printer engine portion and other constituent elements of the printer. Further, sheet guide portions 107*a* and 107*b* are provided on the sheet mounting portion 104 (see FIG. 10). The sheet guide portion 107*a* is fixed to the sheet mounting portion 104. Moreover, the sheet guide portion 107*b* is attached to the sheet mounting portion 104 in such a manner as to be able to move in a transverse direction according to a sheet size.

Next, the details of the configuration of each of the conventional drawer type sheet trays 105 and 106 are described hereinbelow by referring to FIGS. 10 to 12. The conventional drawer type sheet tray 105 is mounted on the rear surface of the sheet mounting portion 104 in such a fashion as to be able to move in a direction parallel to a sheet feeding direction. Further, the sheet tray 106 is mounted on the back surface of the sheet tray 105. As shown in FIG. 12, when the sheet trays 105 and 106 are in an accommodated condition (that is, the non-use condition), these trays are accommodated in a space between the rear surface of the sheet mounting portion 104 and the back cover 102 of a printer body in such a way as to overlap with each other. When the sheet trays 105 and 106 are used, first, the sheet tray 106 is drawn out of the printer body. As the tray 106 is drawn out therefrom, the tray 105 mounted on the surface of the tray 106 is also draw out therefrom.

As described above, the sheet tray 105 is mounted on the rear surface of the sheet mounting portion 104 in the conventional sheet feeder. Thus, an upper part of the sheet mounting portion 104 overlaps with a lower portion of a surface of the sheet tray 105. Therefore, a step-like part is formed in a connection portion between the sheet tray 105 and the printer-body-side sheet mounting portion 104. This causes inconvenience that a sheet of paper is caught by the step-like part formed there between when the sheet of paper is transported along a sheet mounting surface of the sheet tray 105 and then put on the sheet mounting portion 104. Consequently, the conventional sheet feeder has encountered a problem in that this inconvenience adversely affects paper feeding.

SUMMARY OF THE INVENTION

The invention is accomplished to solve the aforementioned problem.

Accordingly, an object of the invention is to provide a sheet feeder enabled to substantially eliminate a difference in sheet-mounting-surface level, which is provided in the connection portion between adjoining two of a plurality of sheet tray portions of a sheet tray, and to provide a sheet tray having such sheet tray portions.

Another object of the invention is to smoothly achieve operations of connecting and accommodating a plurality of sheet tray portions in the sheet feeder and the sheet tray.

To attain the foregoing objects, according to an aspect of the invention, there is provided a sheet feeder that comprises a first sheet tray portion, which is disposed in such a way as to be able to rotate around a shaft provided in such a manner as to be nearly perpendicular to a sheet mounting surface, and enabled to be accommodated in a sheet feeder body, a second sheet tray portion, which is disposed in such a way as to be able to rotate around the shaft and as to be connected to the first sheet tray portion so that the second sheet tray portion partly overlaps with the first the sheet tray portion, and enabled to be accommodated in the sheet feeder body, and a thrusting member for frontwardly pushing the second sheet tray portion when the first and second sheet tray portions are connected to each other. A part of the first sheet tray portion, which overlaps with the second sheet tray portion, has a first thin portion. A part of the second sheet tray portion, which overlaps with the first sheet tray portion, has a second thin portion. The first and second thin portions butt against each other in an overlapping portion in which the first and second sheet tray portions partly overlap with each other, so that there is substantially no difference in sheet-mounting-surface level between the sheet mounting surfaces of the first and second sheet tray portions.

According to the first sheet feeder of the invention, as described above, the first and second tray portions are configured so that there is substantially no difference in sheet-mounting-surface level between the sheet mounting surfaces of the first and second sheet tray portions when the first thin part of the first sheet tray portion and the second thin part of the second sheet tray portion butt against each other in the overlapping portion in which the first and second sheet tray portions partly overlap with each other. Thus, the first sheet feeder effectively prevents an occurrence of inconvenience that a sheet of paper is caught by the step-like part formed between the first and second sheet tray portions when the sheet of paper is put on the sheet mounting surface thereof. Further, the thrusting member for frontwardly pushing the second sheet tray portion when the first and second sheet tray portions are connected to each other (that is, when the sheet feeder is used) is provided in the first sheet feeder. Thus, the sheet tray portions are easily placed in a position, in which the sheet tray portions cause substantially no difference in sheet-mounting-surface level between the sheet mounting surfaces thereof when the first and second sheet tray portions are connected to each other. Incidentally, each of the first and second sheet tray portions is disposed in such a way as to be able to rotate around the shaft that is provided in such a manner as to be nearly perpendicular to a sheet mounting surface, and enabled to be accommodated in the sheet feeder body. Thus, the first and second sheet tray bodies are easily drawn out when these sheet tray bodies are used, and accommodated when these sheet tray bodies are not used, by turning these sheet tray bodies, similarly as a fan is opened and closed.

According to an embodiment (hereunder referred to as a second sheet feeder) of the invention, at least one of the first and second thin portions has a tapered shape.

According to the second sheet feeder of the invention, as described above, at least one of the first and second thin portions is formed in such a way as to have a tapered shape. Thus, when the first and second sheet tray portions are connected to each other (that is, when the sheet feeder is used), the overlapping parts of the first and second sheet tray portions are connected to each other by smoothly overlapping and connecting the first thin portion and the second thin portion along the tapered shape thereof. Moreover, when the first and second tray portions are accommodated in the sheet feeder body, the first and second tray portions are permitted to smoothly overlap with each other. Consequently, operations of connecting and accommodating the first and second tray portions are smoothly performed.

According to an embodiment (hereunder referred to as a third sheet feeder) of the first or second sheet feeder of the invention, the thrusting member includes an abutting rib, which is integrally formed on the rear surface of the second sheet tray portion, for frontwardly the second sheet tray portion by abutting against the sheet feeder body as the second sheet tray portion turns.

According to the third sheet feeder of the invention, the abutting rib for frontwardly the second sheet tray portion by abutting against the sheet feeder body with turning the second sheet tray portion is integrally formed on the rear surface of the second sheet tray portion. Thus, the third sheet feeder has an advantageous effect in that the number of components and the number of man-hours needed for fabricating the sheet feeder remain unincreased even when the abutting rib serving as the thrusting member is added to the sheet feeder.

According to an embodiment (hereunder referred to as a fourth sheet feeder) of one of the first to third sheet feeders of the invention, the fourth sheet feeder further comprises an auxiliary tray provided in such a manner as to be able to be accommodated in the second sheet tray portion.

According to the fourth sheet feeder of the invention, as describe above, the auxiliary tray provided in such a manner as to be able to be accommodated in the second sheet tray portion is additionally provided in the sheet feeder. Thus, the area of a sheet mounting surface is increased still more. Consequently, when a sheet of paper of a large size is put on the sheet mounting surface of the sheet tray body, the sheet of paper is put thereon without bending an upper part of the sheet of paper. Thus, paper feeding is stably performed.

To achieve the foregoing objects, according to another aspect of the invention, there is provided a sheet tray that comprises a first sheet tray portion, which is disposed in such a way as to be able to rotate around a shaft provided in such a manner as to be nearly perpendicular to a sheet mounting surface, and enabled to be accommodated in a sheet feeder body, and also has a second sheet tray portion, which is disposed in such a way as to be able to rotate around the shaft and as to be connected to the first sheet tray portion, and enabled to be accommodated in the sheet feeder body. This sheet feeder further comprises a thrusting member for frontwardly pushing the second sheet tray portion when the first and second sheet tray portions are connected to each other. In this sheet tray, each of the first and second sheet tray portions is formed in such a manner as to have an overlapping part when connected to each other. Further, at least one of the first and second tray portions is formed so that the thickness of the overlapping part thereof is less than that of the remaining part thereof.

According to this sheet tray, as described above, the overlapping parts of the first and second tray portions are constructed so that the thickness of the overlapping part of at least one of the first and second tray portions is less than that of the remaining part thereof. Thus, this effectively prevents an occurrence of inconvenience that a sheet of paper is caught by a step-like part that would be formed between the first and second sheet tray portions when the sheet of paper is put on the sheet mounting surface thereof. Further, this sheet tray has the thrusting member for frontwardly pushing the second sheet tray portion when the first and second sheet tray portions are connected to each other. Thus, when the first and second sheet tray portions are connected to each other (that is, when the sheet feeder is used), the first and second tray portions are easily placed in a predetermined connection position. Incidentally, each of the first and second sheet tray portions is disposed in such a way as to be able to rotate around the shaft that is provided in such a manner as to be nearly perpendicular to a sheet mounting surface, and enabled to be accommodated in the sheet feeder body. Thus, the first and second sheet tray bodies are easily drawn out when these sheet tray bodies are used, and accommodated when these sheet tray bodies are not used, by turning these sheet tray bodies, similarly as a fan is opened and closed.

To achieve the foregoing objects, according to another aspect of the invention, there is provided a sheet feeder (hereunder referred to as a fifth sheet feeder) that comprises a first sheet tray portion, which is disposed in such a way as to be able to rotate around a shaft provided in such a manner as to be nearly perpendicular to a sheet mounting surface, and enabled to be accommodated in a sheet feeder body, and a second sheet tray portion, which is disposed in such a way as to be able to rotate around the shaft and as to be connected to the first sheet tray portion, and enabled to be accommodated in the sheet feeder body, and a thrusting member for frontwardly pushing the second sheet tray portion when the first and second sheet tray portions are connected to each other. In this sheet feeder, each of the first and second sheet tray portions are formed in such a manner as to have an overlapping part when connected to each other. Furthermore, at least one of the first and second tray portions is formed so that the thickness of the overlapping part thereof is less than that of the remaining part thereof.

According to the fifth sheet feeder of the invention, as described above, the overlapping parts of the first and second tray portions are constructed so that the thickness of the overlapping part of at least one of the first and second tray portions is less than that of the remaining part thereof. Thus, this effectively prevents an occurrence of inconvenience that a sheet of paper is caught by a step-like part that would be formed between the first and second sheet tray portions when the sheet of paper is put on the sheet mounting surface thereof. Further, this sheet tray has the thrusting member for frontwardly pushing the second sheet tray portion when the first and second sheet tray portions are connected to each other. Thus, when the first and second sheet tray portions are connected to each other (that is, when the sheet feeder is used), the first and second tray portions are easily placed in a predetermined connection position. Incidentally, each of the first and second sheet tray portions is disposed in such a way as to be able to rotate around the shaft that is provided in such a manner as to be nearly perpendicular to a sheet mounting surface, and enabled to be accommodated in the sheet feeder body. Thus, the first and second sheet tray bodies are easily drawn out when these sheet tray bodies are used, and accommodated when these sheet tray bodies are not used, by turning these sheet tray bodies, similarly as a fan is opened and closed.

DETAILED DESCRIPTION OF THE PREFERRED EMBODIMENTS

Hereinafter, an embodiment of the invention is described with reference to the accompanying drawings.

Figure 1:
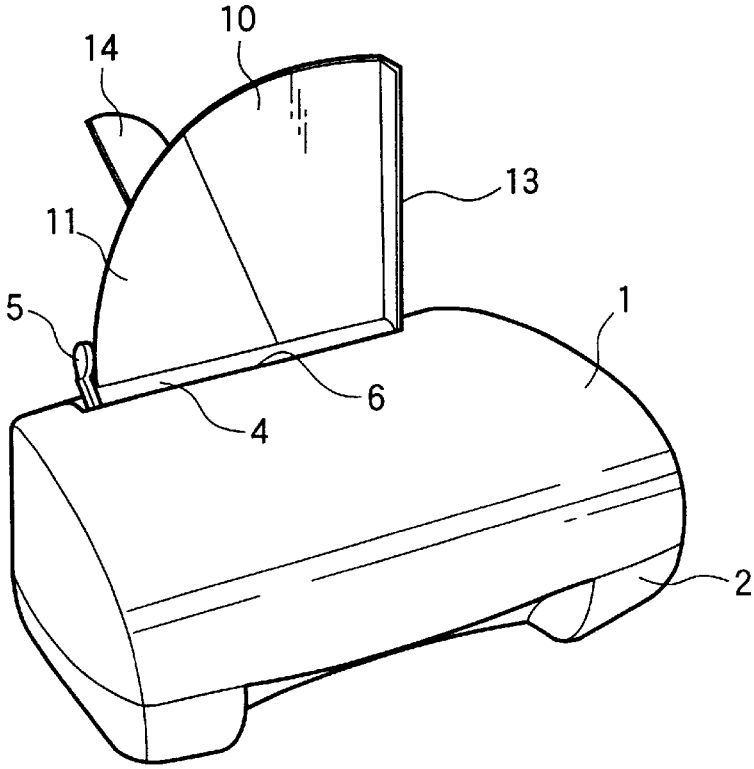
FIG. 1 is a perspective view illustrating a condition (that is, a used condition), in which a sheet tray is drawn out of an ink jet printer having the sheet tray according to an embodiment of the invention.
Figure 2:
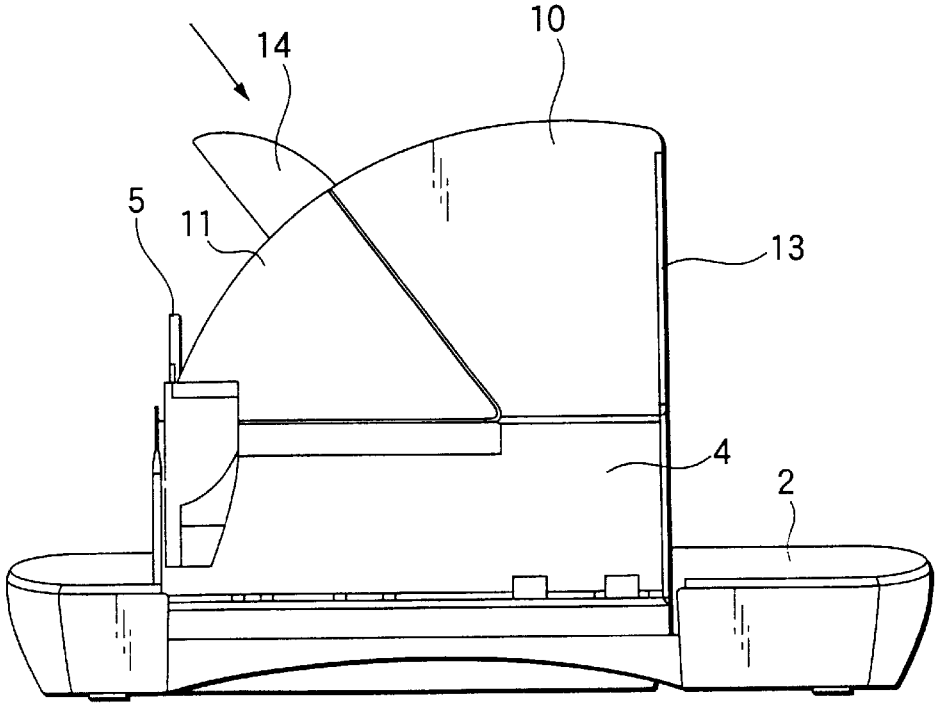
FIG. 2 is a partially sectional view illustrating the ink jet printer, which is the embodiment of the invention shown in FIG. 1, and taken from the front side thereof, as viewed in FIG. 1.
Figure 3:
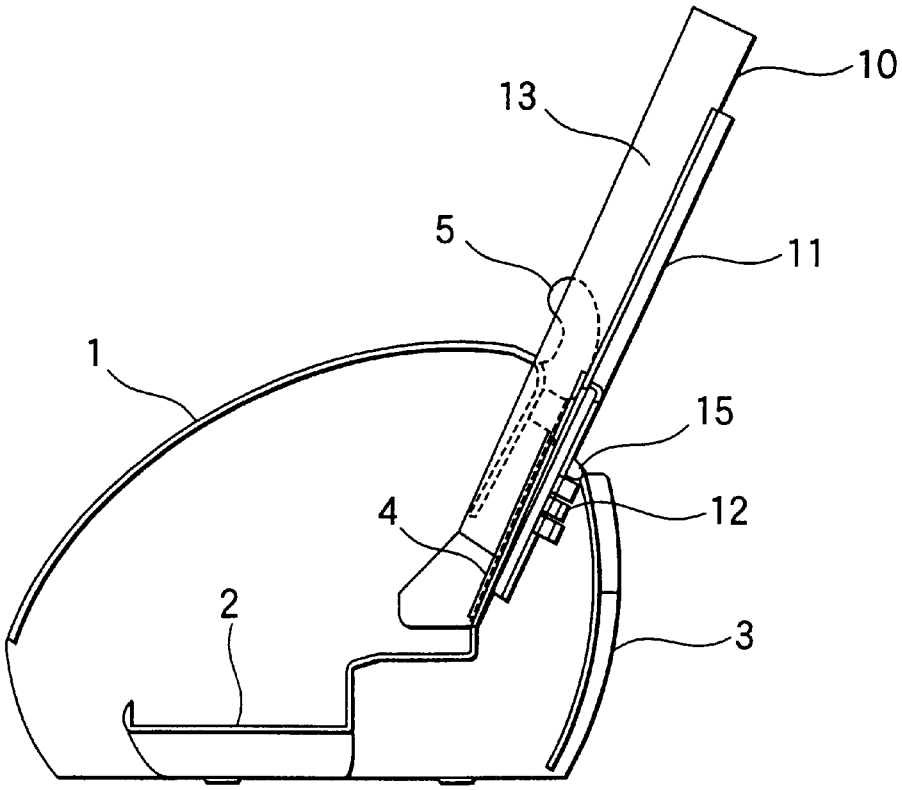
FIG. 3 is a sectional side view illustrating the ink jet printer according to the embodiment of the invention shown in FIG. 1, and taken from the right side thereof, as viewed in FIG. 1.

FIG. 1 is a perspective view illustrating a condition (that is, a used condition), in which a sheet tray is drawn out of an ink jet printer having the sheet tray according to an embodiment of the invention. FIG. 2 is a partially sectional view illustrating the ink jet printer shown in FIG. 1, and taken from the front side thereof, as viewed in FIG. 1. FIG. 3 is a sectional side view illustrating the ink jet printer, which is the embodiment of the invention shown in FIG. 1, and taken from the right side thereof, as viewed in FIG. 1.

First, an outline of the configuration of an ink jet printer according to this embodiment of the invention is described hereinbelow by referring to FIGS. 1 to 3. The ink jet printer of this embodiment has a bottom cover 2, a back cover 3 disposed on the rear surface thereof, and a front cover 1 disposed on the front surface thereof, as shown in FIG. 3. A sheet mounting portion 4 is provided on the bottom cover 2. The bottom cover 2, the back cover 3, and the front cover 1 cover a motor (not shown) for driving a printer engine portion and other constituent elements of the printer. Further, a sheet setting opening 6 is provided between the front cover 1 and the sheet mounting portion 4. Furthermore, as shown in FIGS. 1 and 2, a sheet guide portion 5 is provided on the sheet mounting portion 4. The sheet guide portion 5 is mounted on the sheet mounting portion 4 in such a manner as to be able to move in a transverse direction according to a sheet size.

Figure 4:
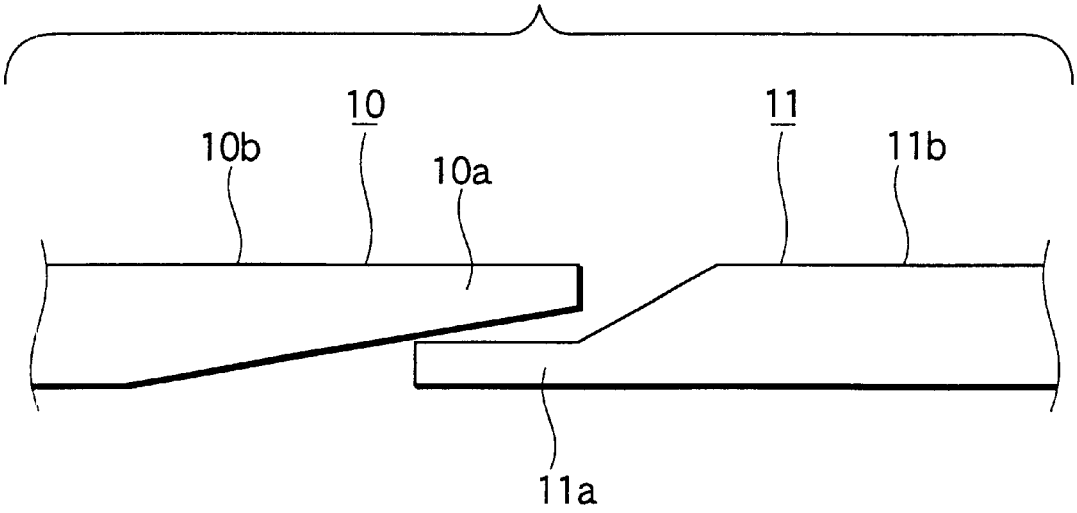
FIG. 4 is a schematic view illustrating a sheet tray of the embodiment of the invention shown in FIG. 2, and taken from a direction of an arrow shown in FIG. 2.
Figure 5:
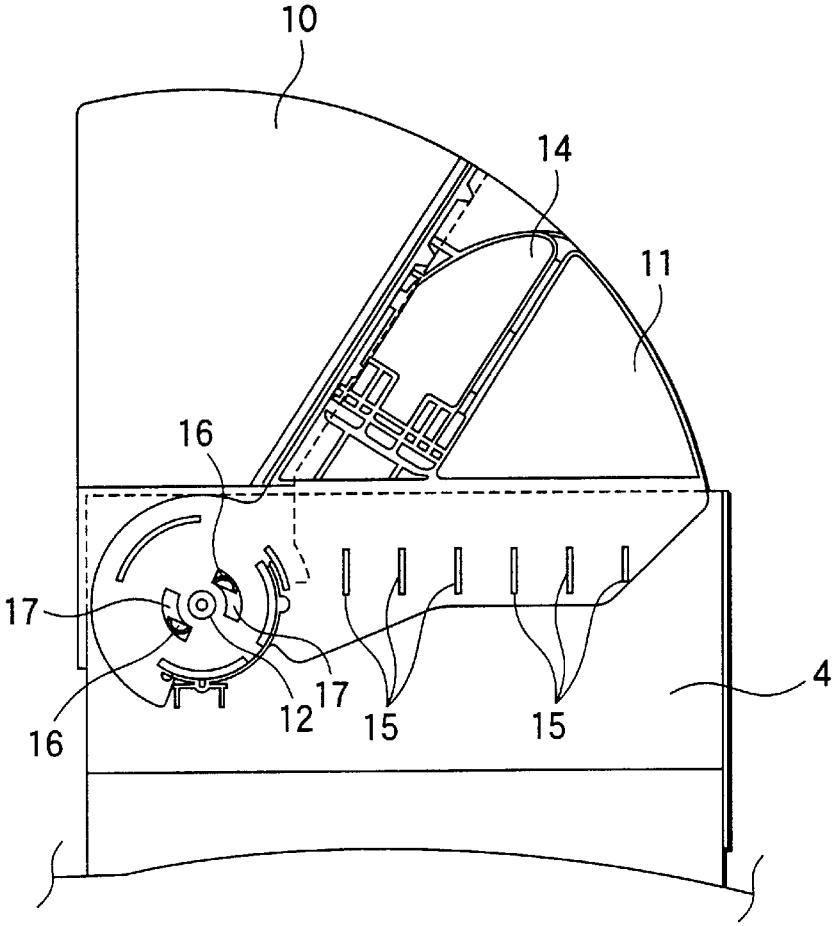
FIG. 5 is a partially sectional view illustrating a condition (that is, a used condition), in which the sheet tray is accommodated in the ink jet printer having the sheet tray according to the embodiment shown in FIG. 1, and taken from the rear side thereof, as viewed in FIG. 1.

FIG. 4 is a schematic view illustrating a sheet tray shown in FIG. 2, and taken from a direction of an arrow shown in FIG. 2. FIG. 5 is a partially sectional view illustrating a condition (that is, a used condition), in which the sheet tray is accommodated in the ink jet printer having the sheet tray according to the embodiment shown in FIG. 1, and taken from the rear side thereof, as viewed in FIG. 1. Next, the details of the configuration of a sheet tray of the sheet feeder according to this embodiment are described herein below by referring to FIGS. 1 to 5. In the sheet feeder of the first embodiment, sheet trays 10 and 11 each have a fan-like shape when these sheet trays are used (that is, when these sheet trays are connected to each other), as shown in FIGS. 1 and 2. The sheet trays 10 and 11 are supported on a shaft 12, which is provided in such a way as to extend in a direction perpendicular to a sheet mounting surface, in such a manner as to be able to laterally turn therearound, as illustrated in FIGS. 3 and 5. This shaft 12 is formed on the rear surface of the sheet mounting portion 4 in such a way as to be integral therewith. Incidentally, the sheet tray 10 corresponds to the "first sheet tray portion" of the invention. Further, the sheet tray 11 corresponds to the "second sheet tray portion" of the invention.

Furthermore, as shown in FIG. 4, each of the sheet trays 10 and 11 has an overlapping part when the sheet trays 10 and 11 are drawn out from a sheet feeder body (that is, when the sheet trays 10 and 11 are used). A thin portion 10*a*, which is the overlapping part of the sheet tray 10, has a tapered shape, the taper angle of which has a constant value. Further, a thin portion 11*a*, which is the overlapping part of the sheet tray 11, has a thin part, which has a constant thickness, and a tapered part connected to the thin part. The thin portions 10*a* and 11*a* are constructed so that the thin portion 10*a* of the sheet tray 10 and the thin part 11*a* of the sheet tray 11 butt against each other when the sheet trays 10 and 11 are used, and that there is substantially no difference in sheet-mounting-surface level between the sheet mounting surface 10*b* of the sheet tray 10 and the sheet mounting surface 11*b* of the sheet tray 11 when the thin portion 10*a* of the sheet tray 10 and the thin part 11*a* of the sheet tray 11 butt against each other.

Furthermore, as shown in FIG. 1, a sheet guide portion 13 is provided on the sheet tray 10. The sheet guide portion 13 is provided in such a way as to be integral with the sheet tray 10. Further, as shown in FIGS. 1 and 2, an auxiliary tray 14 is provided on the rear surface of the sheet tray 11 in such a way as to be able to be accommodated in the sheet feeder body. When the auxiliary tray 14 is in the condition shown in FIG. 1, the tray 14 is in a condition (that is, a used condition), in which the tray 14 is upwardly obliquely drawn out of the sheet feeder body. When the auxiliary tray 14 is accommodated therein, the dray 14 is downwardly obliquely pushed. Moreover, an abutting rib 15 is provided on the rear surface of the sheet tray 11 in such a way as to be integral with the sheet tray 11.

Figure 6:
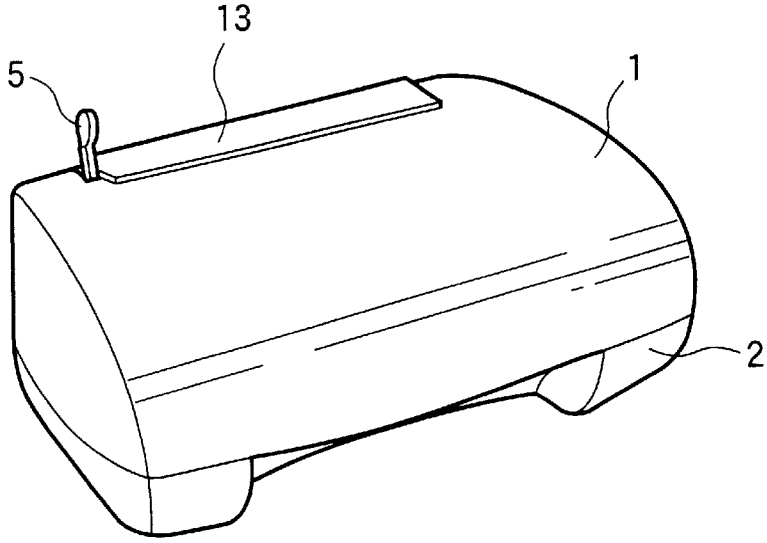
FIG. 6 is a perspective view illustrating a condition in which the sheet tray is accommodated in the ink jet printer having the sheet tray of the embodiment shown in FIG. 1.
Figure 7:
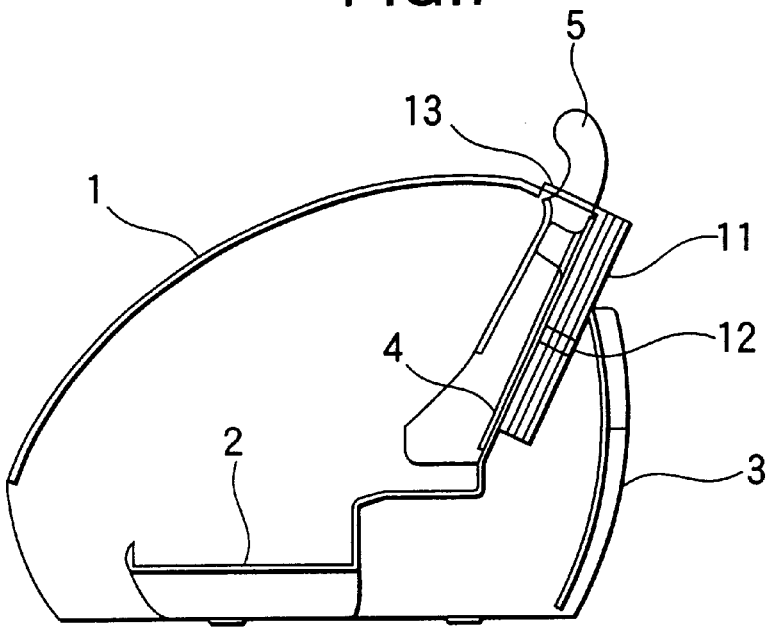
FIG. 7 is a partially sectional view illustrating the ink jet printer according to the embodiment of the invention shown in FIG. 6, and taken from the right side thereof, as viewed in FIG. 6.
Figure 8:
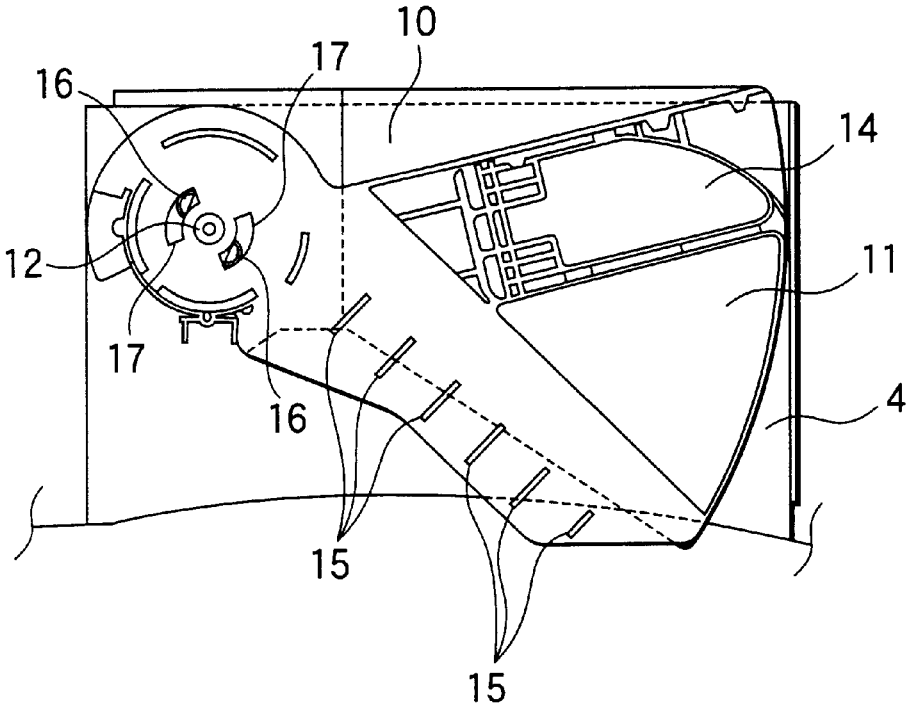
FIG. 8 is a partially sectional view taken from the rear side thereof, as viewed in FIG. 6 and illustrating the ink jet printer according to the embodiment of the invention shown in FIG. 6.
Figure 9:
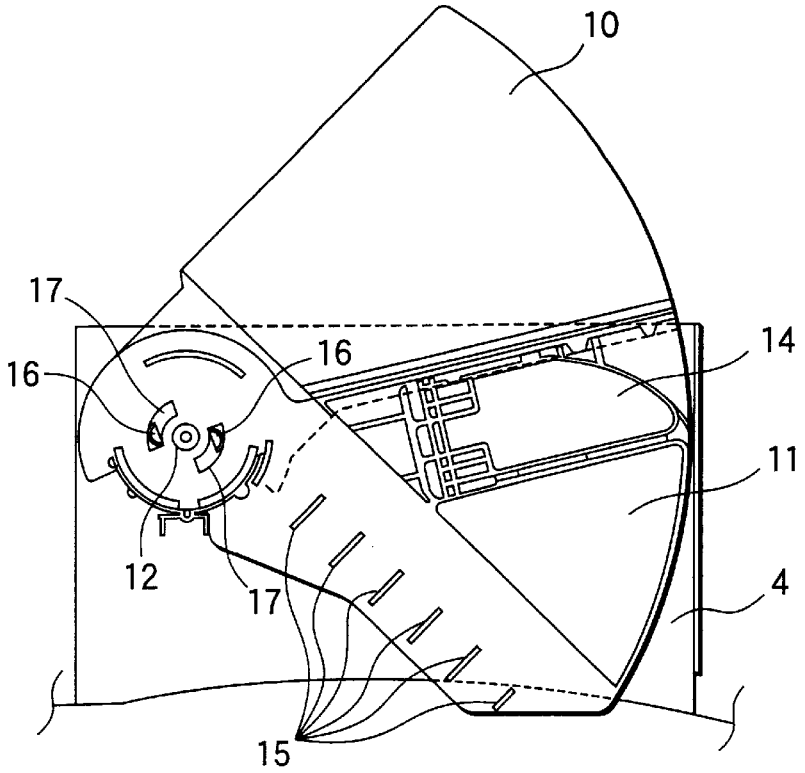
FIG. 9 is a partially sectional view illustrating an operation of the sheet tray of the ink jet printer having the sheet tray of the embodiment shown in FIG. 1.
Figure 10:
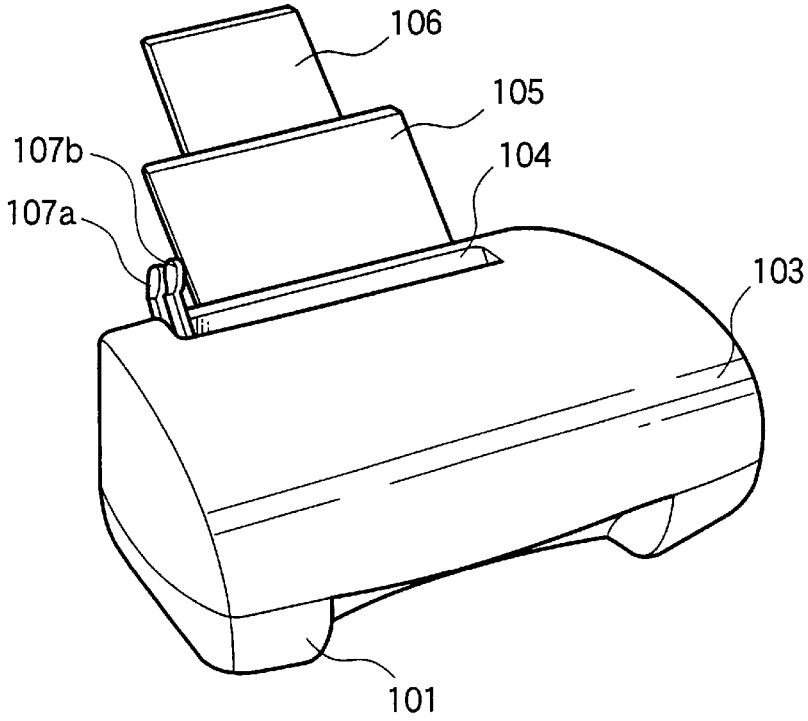
FIG. 10 is a perspective view illustrating a condition (that is, a used condition) in which the drawer type sheet tray is drawn out of a conventional ink jet printer having the drawer type sheet tray.
Figure 11:
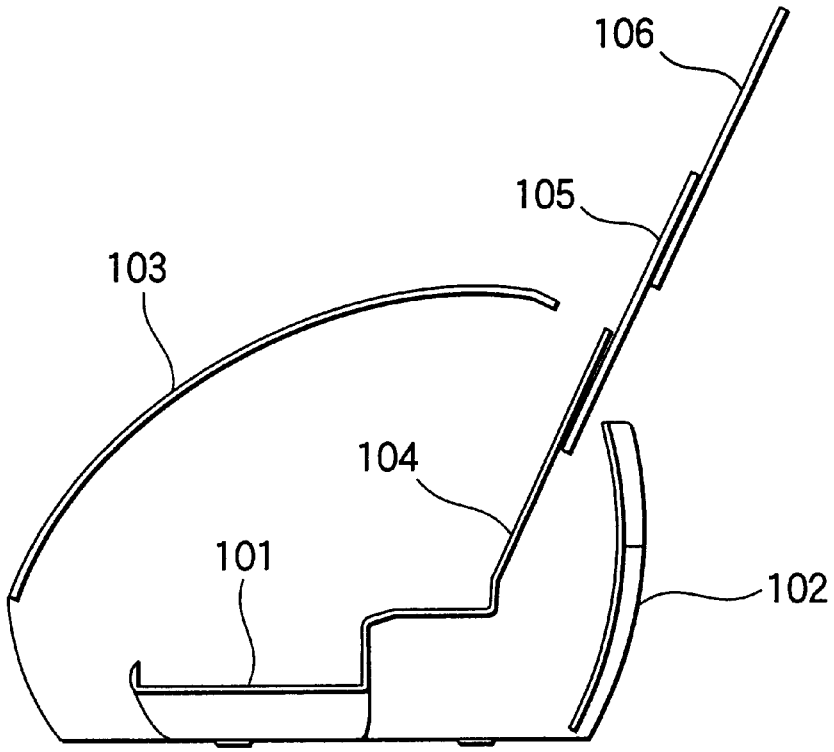
FIG. 11 is a sectional side view taken from the right side, as viewed in FIG. 10 and illustrating a condition (that is, a used condition), in which the sheet tray is drawn out of the conventional ink jet printer.
Figure 12:
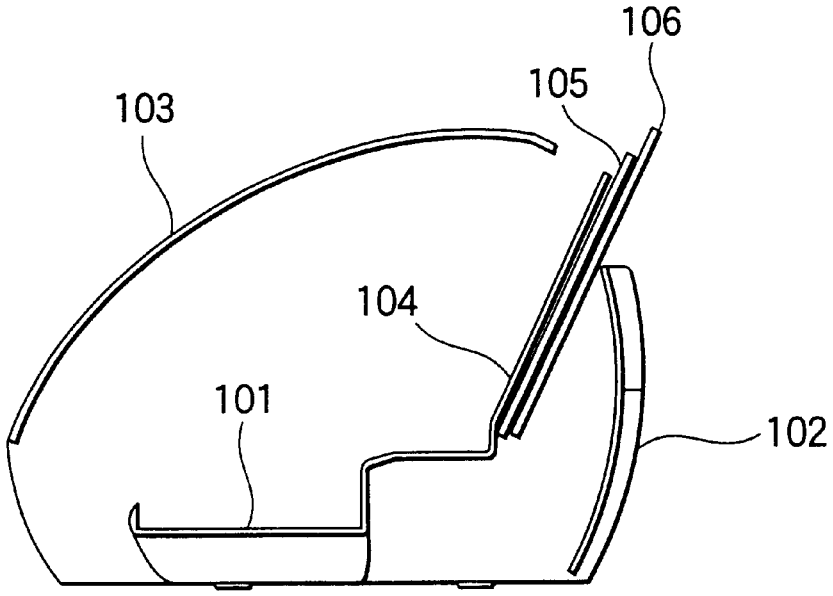
FIG. 12 is a sectional side view taken from the right side, as viewed in FIG. 10 and illustrating an accommodated condition (that is, an unused condition), in which the sheet tray is accommodated in the conventional ink jet printer shown in FIG. 10.

FIG. 6 is a perspective view illustrating a condition in which the sheet tray is accommodated in the ink jet printer having the sheet tray according to the embodiment of the invention. FIG. 7 is a partially sectional view illustrating the ink jet printer shown in FIG. 6, and taken from the right side thereof, as viewed in FIG. 6. FIG. 8 is a partially sectional view taken from the rear side thereof, as viewed in FIG. 6 and illustrating the ink jet printer shown in FIG. 6. FIG. 9 is a partially sectional view illustrating an operation of the sheet tray of the ink jet printer having the sheet tray of the embodiment shown in FIG. 1.

Next, an operation of changing the condition of the sheet tray of this embodiment of the invention from the accommodated condition to the used condition is described hereinbelow by referring to FIGS. 6 to 9.

First, in the accommodated condition, the sheet trays 10 and 11 are accommodated by being made to overlap with each other in the sheet feeder body, as shown in FIGS. 7 and 8. When the sheet trays 10 and 11 are used, first, the sheet tray 10 is drawn out therefrom. At that time, the sheet tray 10 turns around the shaft 12, and is drawn out there from, similarly as a fan is opened. Further, as illustrated in FIG. 9, a projection portion 16 provided on the rear surface of the sheet tray 10 turns around the shaft 12 as the sheet tray 10 turns around the shaft 12. Incidentally, a groove portion 17, to which the projection portion 16 is fitted, is provided in the rear surface portion of the sheet tray 11. When the sheet tray 10 reaches the position shown in FIG. 9, the projection portion 16 reaches an end part of the groove portion 17. Then, when the sheet tray 10 is drawn out (or turned) still more, the groove portion 17 provided in the sheet tray 11 is pushed by the projection portion 16, so that the groove portion 17 turns as the projection portion 16 turns. Thus, the sheet tray 11 provided with the groove portion 17 is drawn out therefrom. Further, as the sheet tray 11 turns, the abutting rib 15 abuts against the upper portion of the inner surface of the back cover 3 (see FIG. 3) to thereby frontwardly push the sheet tray 11.

As described above, this embodiment is constructed so that when the thin part 10*a* serving as the overlapping part of the sheet tray 10 and the thin part 11*a* serving as the 18 overlapping part of the sheet tray 11 butt against each other, there is substantially no difference in sheet-mounting-surface level between the sheet mounting surface 10*b* of the sheet tray 10 and the sheet mounting surface 11*b* of the sheet tray 11. Thus, this embodiment effectively prevents an occurrence of the inconvenience that a sheet of paper is caught by the step-like part when the sheet of paper is put on the sheet mounting surfaces 10*b* and 11*b* thereof.

Further, according to this embodiment, as described above, the abutting rib 15 for frontwardly pushing, when the sheet trays 10 and 11 are connected to each other, the sheet tray 11 with turning the sheet tray 11 is provided on the rear surface of the sheet tray 11. Thus, when the sheet trays 10 and 11 are connected to each other (that is, when the sheet feeder is used), the sheet mounting surface 11*b* of the sheet tray 11 is frontwardly pushed out. Consequently, the sheet mounting surface 11*b* of the sheet tray 11 and the sheet mounting surface 10*b* of the sheet tray 10 are easily placed in a condition that the mounting surface 11*b* is flush with the mounting surface 10*b* and that there is substantially no difference in sheet-mounting-surface level therebetween. Moreover, the abutting rib 15 is provided in such a way as to be integral with the sheet tray 11. Thus, this embodiment has an advantageous effect in that the number of components and the number of man-hours needed for fabricating the sheet feeder remain unincreased even when the abutting rib 15 serving as the thrusting member is added to the sheet feeder.

Moreover, according to this embodiment, each of the sheet trays 10 and 11 is disposed in such a way as to be able to rotate around the shaft that is provided in such a manner as to be nearly perpendicular to a sheet mounting surface, and enabled to be accommodated in the sheet feeder body. Thus, the sheet trays 10 and 11 are easily drawn out when these sheet trays 10 and 11 are used, and accommodated when these sheet tray bodies are not used, by turning these sheet trays 10 and 11, similarly as a fan is opened and closed.

Furthermore, according to this embodiment, the auxiliary tray 14 provided on the rear surface of the sheet tray 11 in such a manner as to be able to be accommodated in the sheet feeder body. Thus, the area of a sheet mounting surface is increased still more. Consequently, when a sheet of paper of a large size is put on the sheet trays 10 and 11, the sheet of paper is put thereon without bending an upper part of the sheet of paper. Thus, sheets of paper are stably supplied.

Incidentally, it should be considered that the embodiment disclosed herein is illustrative in every respect, and that the invention is not limited thereto. The scope of the invention is determined by the appended claims, instead of the foregoing description of the embodiments. Further, all modifications and equivalents, which may occur to those skilled in the art, are considered to be within the scope of the invention.

For example, although the thin portion 10*a* serving as the overlapping part of the sheet tray 10 is formed in such a manner as to have a tapered shape, the taper angle of which has a constant value, a thin portion 11*a* serving as the overlapping part of the sheet tray 11 has a thin part, which has a constant thickness, and a tapered part connected to the thin part in this embodiment, the thin portions of the invention are not limited thereto. Effects similar to those of the embodiment are obtained by forming the thin portion 11*a* of the sheet tray 11 in such a way as to have a tapered shape, the taper angle of which has a constant value, and by forming the thin portion 10*a* of the sheet tray 11 in such a way as to have a thin part, whose thickness is constant, and a tapered part connected to the thin part.

Furthermore, although in the projection portion 16 is provided on the rear surface of the sheet tray 10 and the groove portion 17, into which the projection portion 16 is fitted, is provided in the rear surface portion of the sheet tray 11 this embodiment, the projection portion and the groove portion of the invention are not limited thereto. Effects similar to those of the embodiment are obtained by providing the projection portion on the sheet tray 11 and by providing the groove portion 17, into which the projection portion 16 is fitted, in the rear surface portion of the sheet tray 10.

As described above, the invention provides a sheet feeder and a sheet tray, which are enabled to substantially eliminate the difference in sheet-mounting-surface level between adjoining two of a plurality of sheet tray portions of a sheet tray in a connection portion in which the adjoining two of sheet tray portions are connected to each other.

What is claimed is:

1. A sheet feeder comprising:

a first sheet tray portion disposed to rotate around a shaft provided so as to be nearly perpendicular to a sheet mounting surface, and enabled to be accommodated in a sheet feeder body;

a second sheet tray portion, disposed so as to rotate around said shaft and as to be connected to said first sheet tray portion so that said second sheet tray portion partly overlaps with said first the sheet tray portion, and to be accommodated in said sheet feeder body; and a thrusting member for frontwardly pushing said second sheet tray portion when said first and second sheet tray portions are connected to each other;

wherein an overlapping part of said first sheet tray portion, which overlaps with said second sheet tray portion, has a first thin portion;

wherein an overlapping part of said second sheet tray portion, which overlaps with said first sheet tray portion, has a second thin portion; and wherein said first and second thin portions butt against each other in an overlapping portion in which said first and second sheet tray portions partly overlap with each other, so that there is substantially no difference in sheet-mounting-surface level between the sheet mounting surfaces of said first and second sheet tray portions.

2. The sheet feeder according to claim 1, wherein at least one of said first and second thin portions has a tapered shape.

3. The sheet feeder according to claim 1, wherein said thrusting member includes an abutting rib, integrally formed on a rear surface of said second sheet tray portion, for frontwardly said second sheet tray portion by abutting against said sheet feeder body as said second sheet tray portion turns.

4. The sheet feeder according to claim 1, further comprising an auxiliary tray provided so as to be accommodated in said second sheet tray portion.

5. A sheet tray comprising:

a first sheet tray portion disposed to rotate around a shaft provided as to be nearly perpendicular to a sheet mounting surface, and to be accommodated in a sheet feeder body;

a second sheet tray portion, disposed in such a way as to be able to rotate around said shaft and as to be connected to said first sheet tray portion, and enabled to be accommodated in said sheet feeder body; and a thrusting member for frontwardly pushing said second sheet tray portion when said first and second sheet tray portions are connected to each other, wherein each of said first and second sheet tray portions is formed so as to have an overlapping part when connected to each other; and wherein at least one of said first and second tray portions is formed so that a thickness of said overlapping part thereof is less than that of the remaining part thereof.

6. A sheet feeder comprising:

a first sheet tray portion disposed so as to rotate around a shaft provided so as to be nearly perpendicular to a sheet mounting surface, and to be accommodated in a sheet feeder body;

a second sheet tray portion disposed so as to rotate around said shaft and as to be connected to said first sheet tray portion, and to be accommodated in said sheet feeder body; and a thrusting member for frontwardly pushing said second sheet tray portion when said first and second sheet tray portions are connected to each other;

wherein each of said first and second sheet tray portions are formed so as to have an overlapping part when connected to each other; and wherein at least one of said first and second tray portions is formed so that a thickness of said overlapping part thereof is less than that of the remaining part thereof.

* * * * *